United States Patent [19]

Satake

[11] Patent Number: 4,546,885

[45] Date of Patent: Oct. 15, 1985

[54] DIAGNOSTIC DEVICE FOR COLOR SORTING APPARATUS

[75] Inventor: Toshihiko Satake, Higashihiroshima, Japan

[73] Assignee: Satake Engineering Co., Ltd., Tokyo, Japan

[21] Appl. No.: 534,100

[22] Filed: Sep. 20, 1983

[30] Foreign Application Priority Data

Dec. 25, 1982 [JP] Japan ..... 57-226500

[51] Int. Cl.[4] ..... B07C 5/342

[52] U.S. Cl. ..... 209/548; 209/546; 209/549; 209/580

[58] Field of Search ..... 209/546, 548, 549, 580, 209/581; 340/653

[56] References Cited

U.S. PATENT DOCUMENTS

| | | | |
|---|---|---|---|
| 3,035,232 | 5/1962 | Draganjac et al. | 340/653 X |
| 3,738,484 | 6/1973 | Hoover et al. | 209/581 |
| 3,776,381 | 12/1973 | Wood | 209/549 |
| 4,088,227 | 5/1978 | Lockett | 209/581 |
| 4,252,240 | 2/1981 | Satake | 209/580 |
| 4,283,720 | 8/1981 | Herledan | 340/653 |
| 4,323,159 | 4/1982 | Wolf | 209/548 |

*Primary Examiner*—Robert B. Reeves
*Assistant Examiner*—Edward M. Wacyra
*Attorney, Agent, or Firm*—Wegner & Bretschneider

[57] ABSTRACT

Disclosed is a diagnostic device for use in a color sorting apparatus. A scanner circuit (1–6) successively selects one of a plurality of sorting channels (Q1–Qn) each having a plurality of measuring points (a1–an, b1–bn, c1–cn, d1–dn). A comparator circuit (Ma–Md, Wa–Wd, W'a–W'd, Ha–Hd, G) compares output signals measured at the measuring points and reference signals preset for the respective measuring points. An alarm (8, 9) is provided to indicate a malfunctioning sorting channel and a malfunctioning portion therein. A feeder control (7) may also be provided to interrupt the feeding of grains to a malfunctioning sorting channel.

6 Claims, 1 Drawing Figure

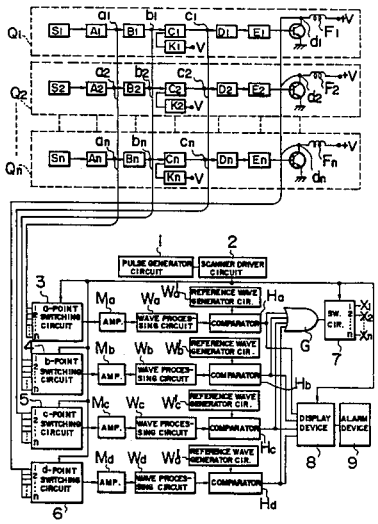

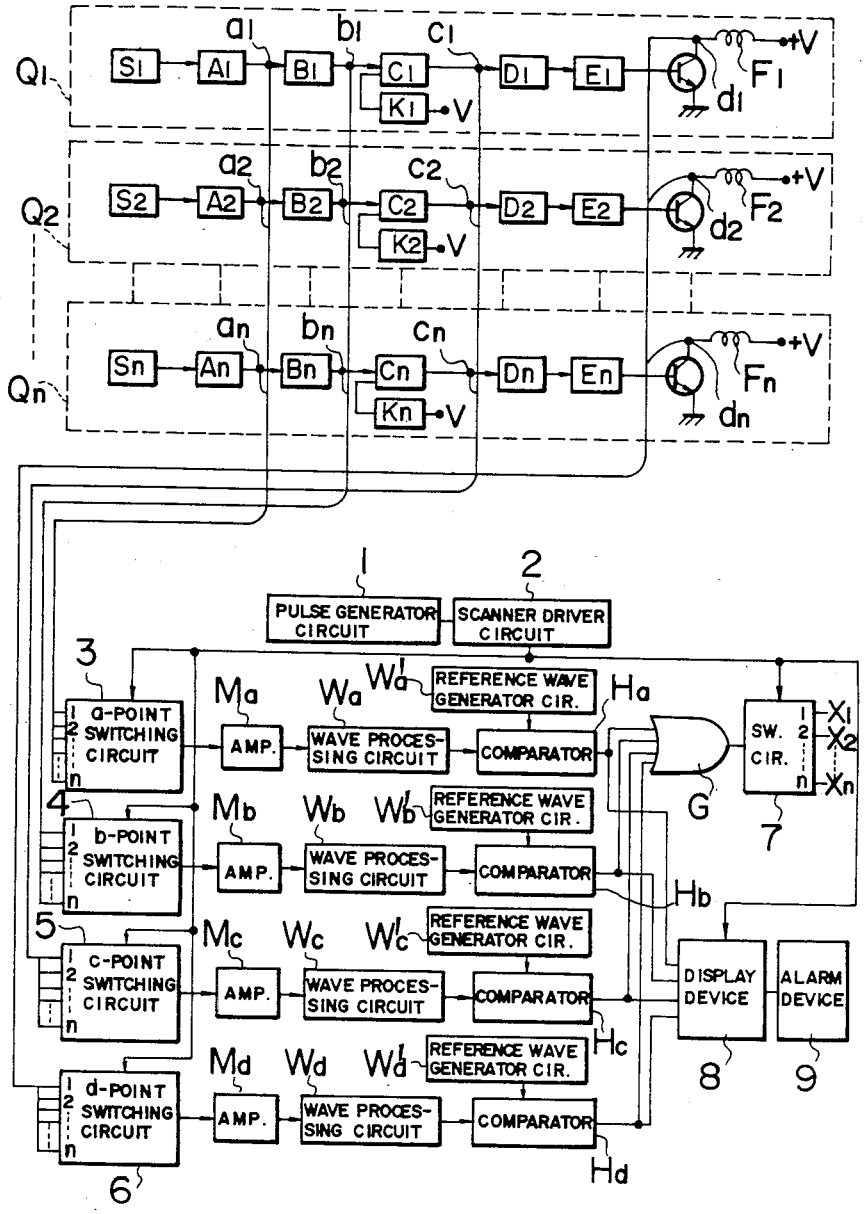
Q1
S1
A1
a1
B1
b1
C1
c1
K1
V
D1
E1
F1
d1
+V
Q2
S2
A2
a2
B2
b2
C2
c2
K2
D2
E2
F2
d2
Qn
Sn
An
an
Bn
bn
Cn
cn
Kn
Dn
En
Fn
dn
1
PULSE GENERATOR CIRCUIT
2
SCANNER DRIVER CIRCUIT
3
a-POINT SWITCHING CIRCUIT
4
b-POINT SWITCHING CIRCUIT
5
c-POINT SWITCHING CIRCUIT
6
d-POINT SWITCHING CIRCUIT
Ma
Wa
W'a
REFERENCE WAVE GENERATOR CIR.
Ha
AMP.
WAVE PROCESSING CIRCUIT
COMPARATOR
Mb
Wb
W'b
Hb
Mc
Wc
W'c
Hc
Md
Wd
W'd
Hd
G
SW. CIR.
7
X1
X2
Xn
DISPLAY DEVICE
8
ALARM DEVICE
9

DIAGNOSTIC DEVICE FOR COLOR SORTING APPARATUS

BACKGROUND OF THE INVENTION

The present invention relates to a diagnostic device for use in a colour sorting apparatus.

A colour sorting apparatus is used for automatically separating grains with a colour different from a reference colour from grains to be sorted such as rice grains, wheat, red beans, soy beans, and peanuts. In such colour sorting apparatus, it is necessary to provide a large number of sorting channels because only one grain at a time is subjected to the sorting operation and therefore there are usually provided 20 to 30 sorting channels. A colour sorting apparatus of the kind to which the diagnostic device according to the present invention may be applied and which has a large number of sorting channels is found in, for example, the U.S. Pat. No. 3,738,484. With a colour sorting apparatus of this kind, if there occurs any malfunction even in only one of those sorting channels, this causes unacceptable grains to be mixed in the acceptable grains which have been sorted, thereby seriously deteriorating the sorting performance of the apparatus.

SUMMARY OF THE INVENTION

Accordingly, it is a primary object of the present invention to provide a diagnostic device for use in a colour sorting apparatus which is capable of detecting from among a large number of sorting channels a particular sorting channel which is out of order.

Another object of the present invention is to provide a diagnostic device for use in a colour sorting apparatus which is capable of controlling the feeders so that the feeding of grains to the malfunctioning sorting channel is interrupted thus contributing to the promotion of a better sorting performance of the apparatus.

In accordance with the present invention, there is provided a diagnostic device for use in a colour sorting apparatus having a plurality of sorting channels, the device comprising: a scanner circuit means having a plurality of switching circuits respectively connected to a plurality of measuring points disposed at each of the sorting channels, the switching circuits being operable to select one after another a particular sorting channel to be measured among the sorting channels; a comparator circuit means for comparing output signals measured at the respective measuring points within the selected sorting channel with reference signals preset for the respective measuring points; and an alarm means for indicating the malfunctioning portion of the selected sorting channel which is out of order upon receipt of the signals from the scanner circuit means and the comparator circuit means, whereby the malfunctioning sorting channel and the malfunctioning portion therein are indicated by the alarm means if there is a discrepancy between the reference signals and the output signals when compared by the comparator circuit means.

The present invention also provides a diagnostic device which further comprises a feeder control means for controlling the operation of feeders respectively arranged for the sorting channels upon receipt of the signals from the scanner circuit means and the comparator circuit means, whereby the malfunctioning sorting channel and the malfunctioning portion therein are indicated by the alarm means and the feeding of grains to the malfunctioning sorting channel is interrupted if there is a discrepancy between the reference signals and the output signals when compared by the comparator circuit means.

BRIEF DESCRIPTION OF THE DRAWINGS

This invention will now be further described, by way of example, with reference to the accompanying drawings.

The illustration is a block diagram showing one preferred embodiment of the present invention.

DESCRIPTION OF THE PREFERRED EMBODIMENTS:

In the drawings, the references Q1–Qn represent respective sorting channels disposed within the colour sorting apparatus, these respective sorting channels Q1–Qn comprising light sensitive sensors S1–Sn for detecting the amount of light from the reference background and the amount of reflected and/or transmitted light from the grains flowing so as to be sorted; pre-amplifiers A1–An for amplifying the outputs fed from the sensors S1–Sn; main amplifiers B1–Bn; and comparators C1–Cn for comparing the outputs sent from the main amplifiers B1–Bn with the reference outputs set-up by means of level setters K1–Kn and producing outputs at the passage of a grain of a colour different from the reference colour (hereinafter referred to as a substandard grain). Output signals from the comparators C1–Cn are delayed by signal delay circuits D1–Dn and driver circuits E1–En are activated so as to actuate electromagnetic valves F1–Fn of an ejector, thereby blowing off the substandard grain with compressed air from the ejector when the substandard grain passes in front of the ejector. Measuring points a1–an which are output points of the pre-amplifiers A1–An, measuring points b1–bn which are output points of the main amplifiers B1–Bn, measuring points c1–cn which are output points of the comparators C1–Cn and measuring points d1–dn which are collector terminals of the transistors the base terminals of which are connected to the outputs of the driver circuits E1–En and which are adapted to activate the electromagnetic valves F1–Fn of the ejector are respectively connected to a-point switching circuit 3, b-point switching circuit 4, c-point switching circuit 5 and d-point switching circuit 6 of a scanner circuit means which includes a pulse generator circuit 1, a scanner driver circuit 2 and these a-, b-, c-, d-point switching circuits 3, 4, 5, 6. These a-, b-, c-, d-point switching circuits 3, 4, 5, 6 and the switching circuit 7, hereunder to be explained, are operated to switch their stationary contacts one to another successively by the scanner driver circuit 2 which is adapted to be operable in response to the pulses fed from the pulse generator circuit 1.

The outputs of the scanner circuit means are applied to a comparator circuit means which includes amplifiers Ma–Md, wave processing circuits Wa–Wd, comparators Ha–Hd, reference waveform generator circuits W'a–W'd and an OR gate G. Thus, the respective outputs of the a-, b-, c-, and d-point switching circuits 3, 4, 5 and 6 are applied, through the respective amplifiers Ma–Md and the wave processing circiuts Wa–Wd, to the respective comparators Ha–Hd, to which reference signals are also applied from the reference waveform generator circuits W'a–W'd, where the signals from the wave processing circuits Wa–Wd are compared with the above reference signals, respectively. The outputs of the comparators Ha–Hd are input to the OR gate G and the output of this OR gate G is in turn applied to a feeder control means, that is, the above switching circuit 7. Outputs of this switching circuit 7 are respectively connected to feeders X1–Xn which are means for feeding or stopping the grains to the respective sorting channels. The outputs of the comparators Ha–Hd are also applied to a display device 8 which is arranged also to receive an output signal from the abovementioned scanner driver circuit 2 and which is further connected to an alarm device 9 such as a buzzer or bell. An alarm means may be formed by the display device 8 alone or together with the alarm device 9.

Next, the operation of the diagnostic device for the colour sorting apparatus embodying the present invention will be explained below.

Let us suppose that the colour sorting apparatus is now in an operating state and that grains to be sorted are flowing down in each of the sorting channels Q1–Qn. Under this condition, each of the sensors S1–Sn for the respective sorting channels Q1–Qn detects the colour of the grains flowing down the respective channels and sends out a certain detection signal. On the other hand, the scanner driver circuit 2 operates upon receipt of the pulse signals from the pulse generator circuit 1 to drive the respective a-, b-, c-, d-point switching circuits 3, 4, 5, 6 and the switching circuit 7 so as to switch their respective contacts in succession from 1 to n stationary contacts in a synchronous manner. Let us now suppose that, for example, the stationary contacts "2" in the respective switching circuits are selected by the scanner driver circuit 2. The respective measuring points a2, b2, c2, d2 within the sorting channel Q2 are electrically connected through the respective a-, b-, c-, d-point switching circuits 3, 4, 5, 6 to the amplifiers Ma–Md where the output signals measured at the respective measuring points a2, b2, c2, d2 are amplified. The signals being amplified at the amplifiers Ma–Md are then passed to the wave processing circuits Wa–Wd where they are wave-processed so as to be made applicable for the comparison operation, and in turn passed to the comparators Ha–Hd where the processed signals are compared with the reference signals produced by means of the reference waveform generator circuits W'a–W'd. Under these circumstances, when at least one of the processed signals does not correspond to the associated reference signal, corresponding one of the comparators Ha–Hd sends out a signal which causes the feeder X2, through the OR gate G and the selected stationary contact "2" of the switching circuit 7, to stop the feeding of grains to the sorting channel Q2.

The display device 8 receives the output signals from the comparators Ha–Hd and is arranged to operate to indicate each sorting channel number synchronously with the stationary contacts of the respective switching circuits 3–7 by the scanner driver circuit 2. Thus, supposing that the comparator Hb sends out an output signal, the display device 8 operates to indicate the number, which in this case is number "2", representing the present number of the particular sorting channel undergoing measuring operation which has been selected by the respective switching circuits 3–6, and also the display device 8 operates to indicate the character "b", based upon the output signal from the comparator Hb, representing the measuring point where any malfunction has occurred. As a result, there will be an indication of "2-b" showing that there is a malfunction at the b-point within the sorting channel Q2. In addition to this visual indication, the alarm device 9 of bells or the like operates to give warning of an occurrence of any malfunction in an audible manner.

In the above described embodiment, there are arranged four measuring points (two measuring points for the amplifiers and one each for the comparator and the driver circuit) per sorting channel within the apparatus, but five or six or more measuring points may well be arranged if desired. The increase in measuring points will ensure circumstantial discovery of malfunctioning portions.

As has been described hereinabove, the first advantageous effect offered by the present invention is that when any portion within the sorting channel is out of order within the colour sorting apparatus having a large number of sorting channels, the malfunctioning sorting channel and the malfunctioning portion therein are indicated on the display device so that any malfunctioning parts can be quickly discovered and repaired.

The second advantageous effect, in addition to the one given above, is that since the feeding of grains to the sorting channel out of order can be timely stopped, there is less possibility of substandard grains being mixed in the acceptable grains and this contributes to the promotion of better sorting performance, and also the fact that the malfunctioning sorting channel can be quickly restored means the improvement of overall sorting efficiency of the colour sorting apparatus.

While the invention has been described in its preferred embodiments, it is to be distinctly understood that the invention is not limited thereto but may be otherwise variously embodied within the scope of the following claims.

What is claimed is:

1. A diagnostic device for a colour sorting apparatus having a plurality of sorting channels, the device comprising:

a scanner circuit means having a plurality of switching circuits respectively connected to a plurality of measuring points disposed at each of said sorting channels, the switching circuits being operable to select one after another successively a particular sorting channel to be measured among said sorting channels;

a comparator circuit means for comparing output signals measured at said respective measuring points within said selected sorting channel with reference signals preset for said respective measuring points; and an alarm means for indicating the malfunctioning portion of said selected sorting channel which is out of order upon receipt of the signals from said scanner circuit means and said comparator circuit means, whereby the malfunctioning sorting channel and the malfunctioning portion therein are indicated by said alarm means if there is a discrepancy between said reference signals and said output signals when compared by said comparator circuit means.

2. A diagnostic device for a colour sorting apparatus according to claim 1 wherein said alarm means comprises a display device for indicating the malfunctioning sorting channel and the malfunctioning portion therein.

3. A diagnostic device for a colour sorting apparatus according to claim 1 wherein said alarm means comprises an alarm device for warning of an occurrence of any malfunction in an audible manner.

4. A diagnostic device for a colour sorting apparatus having a plurality of sorting channels, the device comprising:

a scanner circuit means having a plurality of switching circuits respectively connected to a plurality of measuring points disposed at each of said sorting channels, the switching circuits being operable to select one after another successively a particular sorting channel to be measured among said sorting channels;

a comparator circuit means for comparing output signals measured at said respective measuring points within said selected sorting channel with reference signals preset for said respective measuring points;

an alarm means for indicating the malfunctioning portion of said selected sorting channel which is out of order upon receipt of the signals from said scanner circuit means and said comparator circuit means; and a feeder control means for controlling the operation of feeders respectively arranged for said sorting channels upon receipt of said signals from said scanner circuit means and said comparator circuit means, whereby the malfunctioning sorting channel and the malfunctioning portion therein are indicated by said alarm means and the feeding of grains to said malfunctioning sorting channel is interrupted if there is a discrepancy between said reference signals and said output signals when compared by said comparator circuit means.

5. A diagnostic device for a colour sorting apparatus having a plurality of sorting channels, each of which includes a light sensitive sensor for detecting light from grains to be sorted, an amplifier for amplifying an output received from said sensor, a comparator for comparing the amplified light sensor output emitted from said amplifier with a reference signal, a driver circuit for producing a signal based on the output sent from said comparator and an ejector for blowing away a substandard grain based on said signal from said driver circuit, said diagnostic device comprising:

measuring points in each said sorting channel coupled to at least said amplifier, comparator and driver circuit, scanner circuit means for selectively emitting signals measured at each of said respective measuring points within each sorting channel, said scanner circuit means having a plurality of switching channels, the respective inputs of which are connected to said measuring points of the plurality of said sorting channels, said switching circuits operating to successively select sorting channels to be measured, comparator circuit means for comparing signals measured at said respective measuring points within the sorting channel selected by said scanner circuit means with the reference signals preset for said respective measuring points, alarm means for indicating a malfunctioning sorting channel and a malfunctioning portion of said malfunctioning sorting channel, upon receipt of signals from said scanner circuit means and said comparator circuit means indicating a predetermined difference between said reference signals and signals measured at said measuring points, and feeder control means for interrupting feeding of grains to said malfunctioning sorting channel upon receipt of signals from said scanner circuit means and said comparator circuit means indicating said predetermined difference between said reference signals and signals measured at said measuring points.

6. A diagnostic device for a colour sorting apparatus according to claim 5 wherein said alarm means comprises audible means for warning of an occurrence of any malfunction.

* * * * *